United States Patent [19]

Bitar

[11] Patent Number: 4,548,561

[45] Date of Patent: Oct. 22, 1985

[54] ROTARY HYDRAULIC MACHINE WITH A MULTIPLICITY OF AXIALLY ALIGNED CHAMBERS

[76] Inventor: Joseph Bitar, 16, rue Felicien David, 75016 Paris, France

[21] Appl. No.: 603,649

[22] Filed: Apr. 24, 1984

[30] Foreign Application Priority Data

Mar. 16, 1984 [FR] France ..... 84 04050

[51] Int. Cl.[4] ..... F01C 1/00; F01C 11/00; F03C 2/00

[52] U.S. Cl. ..... 418/184; 418/188; 418/213

[58] Field of Search ..... 418/184, 188, 213, 212, 418/187

[56] References Cited

U.S. PATENT DOCUMENTS

| | | | |
|---|---|---|---|
| 753,262 | 3/1904 | Horan | 418/184 |
| 789,774 | 5/1905 | Walda | 418/184 |
| 824,647 | 6/1906 | Hamann | 418/184 |
| 1,053,767 | 2/1913 | Allan | 418/213 |
| 2,200,198 | 5/1940 | Beach | 418/184 |
| 2,799,371 | 7/1957 | Osborn | 418/184 |

FOREIGN PATENT DOCUMENTS

| | | | |
|---|---|---|---|
| 5456 | 12/1955 | Fed. Rep. of Germany | 418/184 |
| 900044 | 1/1982 | U.S.S.R. | 418/184 |

*Primary Examiner*—John J. Vrablik
*Attorney, Agent, or Firm*—Browdy and Neimark

[57] ABSTRACT

The invention relates to a hydraulic machine useful in pumping, drilling, etc. especially at great distances, comprising a housing defining a multiplicity of eccentric working chambers. A rotor is mounted to rotate in each chamber and comprises, in a radial recess, a distribution and separation element which separates the chamber into two spaces: an inactive space emptied by a lateral bore in the housing; and an active space that receives fluid under pressure via a shaft solid with the rotor and a hollow made in the separation element. The fluid under pressure rotates the rotor by exerting its thrust on the separation element.

8 Claims, 10 Drawing Figures

FIG. 2
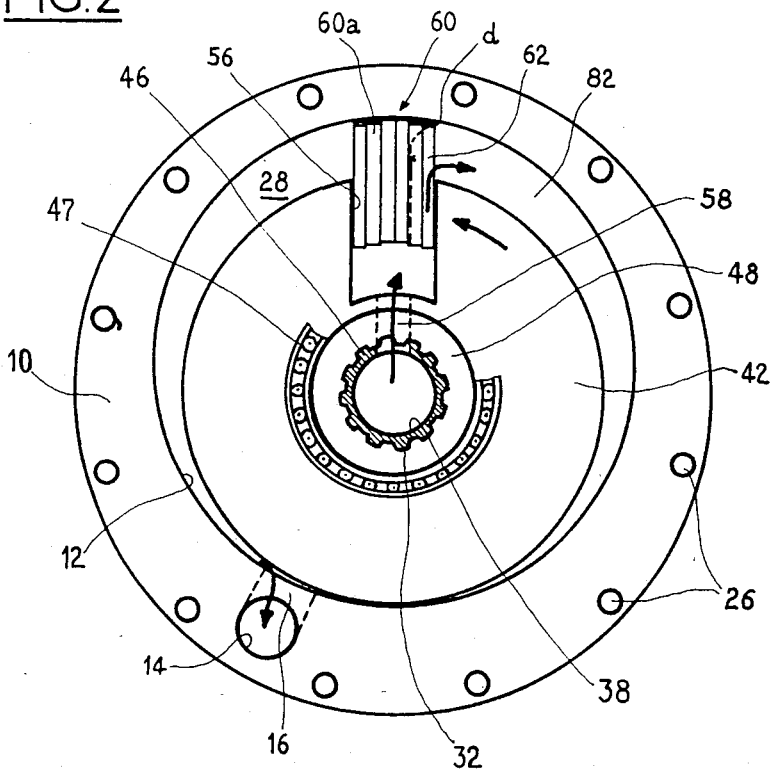
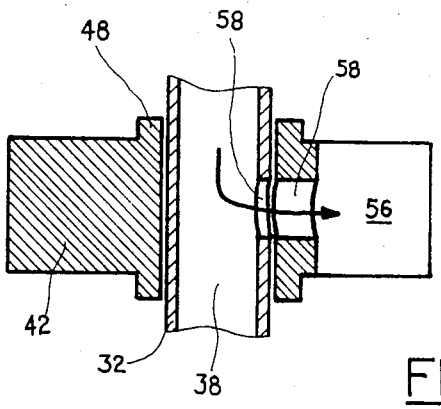
FIG. 4

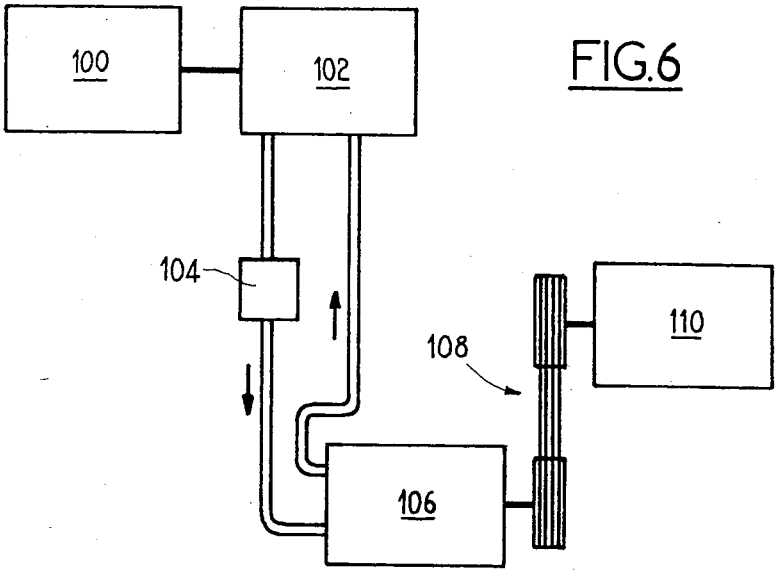
FIG.6
FIG.7
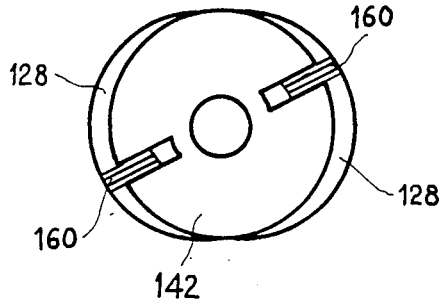

ROTARY HYDRAULIC MACHINE WITH A MULTIPLICITY OF AXIALLY ALIGNED CHAMBERS

FIELD OF THE INVENTION

This invention relates in a general way to hydraulic machines or turbines, driven in rotation by pressure or displacement of a fluid.

BACKGROUND OF THE INVENTION

For a very long time various types of hydraulic machines have been known which rely on a rotating element provided with blades or vanes, the rotation driving force being generated by the pressure or displacement of a fluid discharged onto the blades or vanes by a distribution system.

However, none of these known types of hydraulic machines can exhibit at the same time a satisfactory energy efficiency at all rotation speeds in a range between zero speed and a relatively high speed.

Further, known hydraulic machines are relatively bulky as soon as the output power to be supplied is increased to relatively high levels.

Finally, these known machines all exhibit a certain inertia, which prevents their use in applications where instantaneous starting and stopping are required.

SUMMARY AND OBJECTS OF THE INVENTION

This invention aims at eliminating the above drawbacks by proposing a hydraulic machine or turbine which operates upon a new principle, which can operate with close to 100% efficiency at any rotation speed, that can, for example, go up to 3000 rpm, which has a very small size, even for high output power, and where starting and stopping are practically instantaneous, i.e., nominal output torque can be reached immediately after starting the hydraulic fluid feed under pressure.

Another object of this invention is to propose a new hydraulic machine of a simple and inexpensive design that can operate without any modification under any kind of power and speed conditions.

For this purpose, this invention relates to a hydraulic machine of the type generating a mechanical energy from a fluid feed under pressure, wherein the machine comprises at least a working chamber in which a cylindrical rotor solid with an output shaft of the machine is mounted to rotate around an axis, and the chamber and the rotor together defining an annular working space of variable width, with the space being substantially zero at at least a line of contact between the rotor and a wall of the chamber. Intake means are provided centrally in the rotor and at least a radial recess is made in the rotor and communicates with the intake means by its inside end. A distribution and separation element is mounted to slide radially in said recess and is flattened by the fluid pressure against said chamber wall to separate said working space into a first space which is simultaneously put in communication with the intake means by uncovering of a distribution passage made in the distribution and separation element and into a second space which is isolated from the intake means and in communication with the fluid output means. The accumulation of fluid under pressure in the first space pushes back said distribution and separation element thus causing the rotor, and therefore the output shaft, to turn. The inert fluid located in the second chamber is simultaneously driven from it by said distribution and separation element through said output means.

BRIEF DESCRIPTION OF THE DRAWINGS

The invention will be better understood from a reading of the following detailed description of a preferred embodiment of a hydraulic machine according to the invention, given by way of example and made in reference to the accompanying drawings in which:

FIG. 2 is a view in cross-section along line 11—11 of the machine of FIG. 1, FIGS. 3A to 3D are schematic views showing the operation of the machine of FIGS. 1 and 2, FIG. 4 is a detail view in section of a part of the machine of FIGS. 1 and 2, FIG. 6 is a schematic diagram of an application of said machine, and FIG. 7 is a schematic view of a second embodiment of the invention machine.

DETAILED SPECIFICATION

Figure 1:
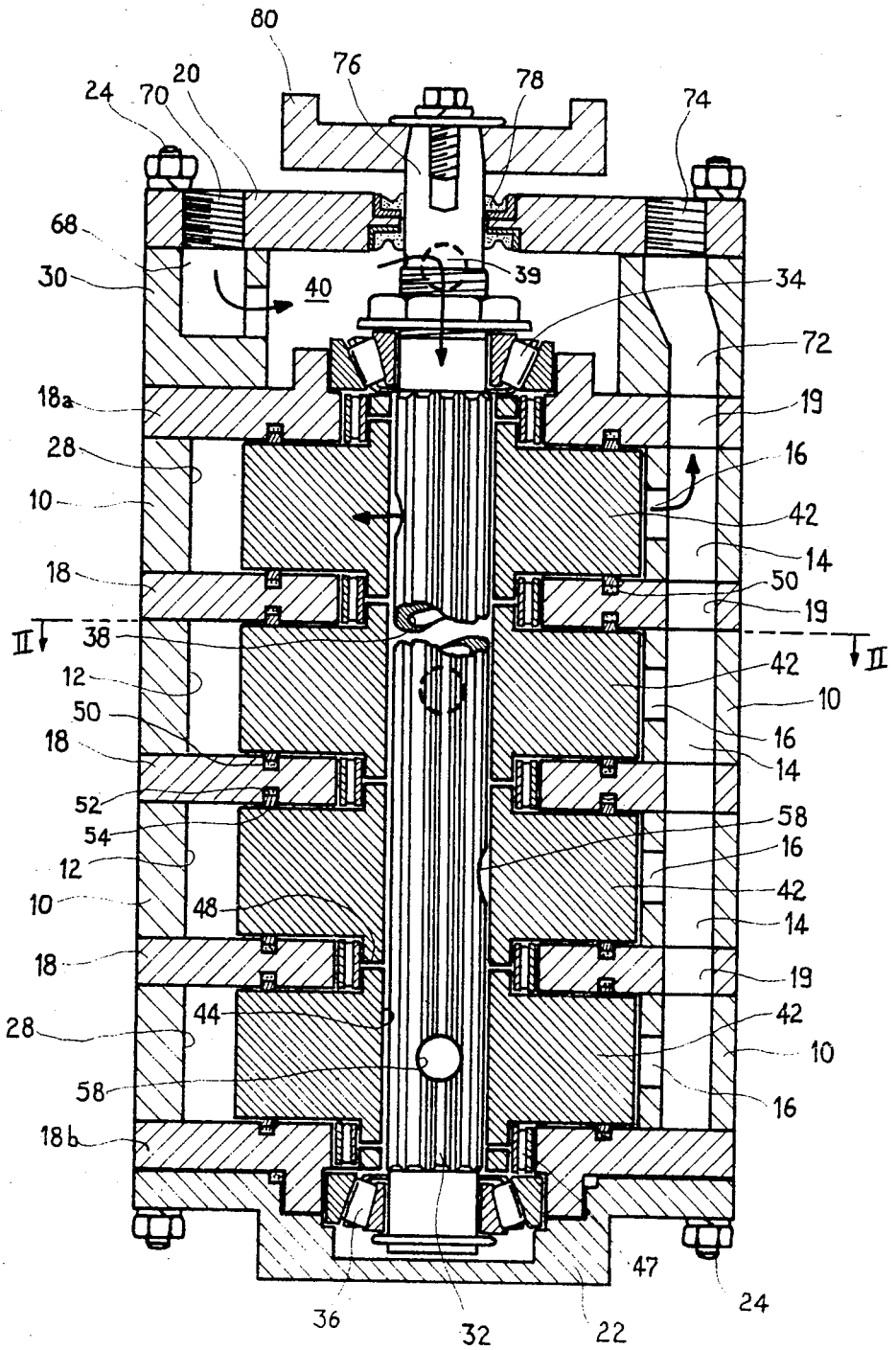
FIG. 1 is a view in vertical longitudinal section of a preferred embodiment of a hydraulic machine according to the invention.

With reference to the drawings, and more particularly to FIGS. 1 and 2, the hydraulic machine of the invention comprises a main outside housing 10, approximately cylindrical in shape, through which an eccentric bore 12 of circular section extends lengthwise, which hereafter will be called the working chamber. A fluid output bore 14 extends through housing 10, in its thickest region, parallel to bore 12, and communicates with the inside of bore 12 by four radial passages 16 regularly spaced along the axis of housing 10.

More specifically, as FIG. 1 shows, outside housing 10 consists of four cylindrical housing sections superposed and separated from one another by separation partitions 18 in the shape of disks. Each partition 18 has an outside diameter equal to that of housing 10, and exhibits a central opening, as will be seen below, and a passage 19 putting output bores 14 of the housing sections in communication with one another. An upper housing 20 and a lower housing 22 are, further, respectively mounted at the upper end and lower end of housing assembly 10, and the unit is rigidly assembled together by a multiplicity of bolts 24 (not shown in FIG. 2) going through appropriate coinciding holes 26 made in upper and lower housings 20, 22, in partitions 18 and in housing section 10 to the periphery of the latter thus to define a four-chamber working unit 28, as will be seen below.

The upper part of the unit thus defined located between the uppermost chamber and upper housing 20, and delimited by an outside duct housing 30, will be described in detail below.

Still with reference to FIGS. 1 and 2, the machine further comprises, going through the latter axially through the central openings of partitions 18 and extending over the entire length of working chambers 28, a hollow grooved shaft 32 mounted to rotate in bearings 34 and 36 respectively on the upper and lower partitions, indicated respectively as 18*a* and 18*b*. As will be seen below, the upper end of shaft 32 is open at 39, its central bore 38 thus communicating with an intake chamber 40 defined between outer housing 30, upper partition 18*a* and upper housing 20.

In each working chamber 28 is mounted a cylindrically shaped rotor 42 which in its center exhibits an axial bore 44 comprising a series of grooves made to correspond to the grooves 46 of shaft 32, the four rotors 42 thus being made effectively solid in rotation together with shaft 32. It can be noted that the radius of each rotor 42 is precisely equal to the minimal distance between the axis of the machine and the wall of the eccentric working chambers 28, so that each rotor is made flush with its associated chamber wall along a vertical line of contact assuring a fluid tightness, as will be seen below. Rotors 42 are supported in rotation in their respective working chambers 28 by bearings 47 inserted between the respective inside faces of the central openings of partitions 18 and suitable steps 48 made on the upper and lower faces of each rotor and surrounding grooved shaft 32. A suitable fluid tightness is assured between each rotor 42 and the associated faces of partitions 18 by means of seals or circular segments received in corresponding grooves 50 made in the upper and lower faces of each intermediate partition 18, in the lower face of upper partition **18*a* and in the upper face of lower partition 18*b***.

Each seal may be made by superposing a cork seal 52 and a copper seal 54 for example. These seals are located approximately half-way between the central axis of the machine and its periphery.

Thus, and as can be seen in FIG. 2, because of the eccentric position of bore 12 defining working chambers 28, said chambers and associated rotors 42 between them define a cresent-shaped space, which space is important to the operation of the invention machine.

With reference to FIGS. 2 and 4, it can be observed that each rotor 42 exhibits, extending over the whole of its axial length, a radial recess 56 of approximately parallelipiped shape which communicates with central bore 38 of grooved shaft 32 through a radial passage 58. Recess 56 of each rotor 42 intimately receives a laminated distribution and separation element 60 (see also FIG. 5) which extends over the entire axial length of the rotor, thus being flush against the upper and lower faces of the latter to be in tight contact with the associated faces of partitions 18 by assuring a suitable fluid tightness with seals 52, 54. The axial length of each element 60 is approximately equal to that of its associated recess 56, element 60 being able to slide radially in this recess. It must be noted that each element 60 consists of a multiplicity of parallel individual plates **60*a*** free to slide with respect to each other.

Figure 5:
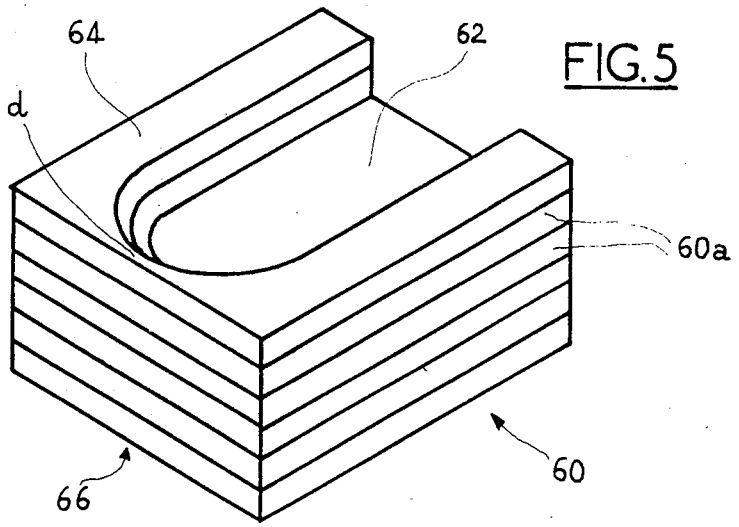
FIG. 5 is a perspective view of another part thereof.

With reference to FIGS. 2 and 5, it can be observed that distribution and separation element 60 exhibits on one of its lateral faces 64 a hollow distribution passage 62 putting the bottom of associated recess 56 in communication with the radially outside region of said face 64, which hereafter will be called the drive face, namely the face on the right in FIG. 2. The opposite face 66, called the escape face, on the left FIG. 2, and at the bottom in FIG. 5, being solid.

Finally, it is to be noted that the four rotors 42 exhibit, inside their respective working chambers 28, angular positions offset 90° in relation to one another for purposes explained below. In this regard, the four radial passages 58 of central shaft 32, in respective communication with recesses 56 rotors 42, are of course also offset by 90°, as FIG. 1 shows. It will also be noted here that, for this phase displacement of the rotors by 90° to be able to be obtained, the number of grooves of shaft 32 must be a multiple of 4.

Again with reference to FIG. 1, it is seen that annular outside housing 30 located between upper partition **18*a* and upper housing 20 exhibits a bent intake passage 68 that puts a threaded hole 70, opening to the outside, in communication with the inside of intake chamber 40. Annular housing 30 further exhibits, in the region of its periphery, an output passage 72 that puts output bore 14 of housing 10 in communication with a threaded hole 74 opening to the outside. Said threaded holes 70, 74** are made to be connected respectively to a feed pipe of fluid under pressure and to a fluid recovery pipe (not shown).

Finally, grooved shaft 32 comprises, in one piece with it, an upward extension 76 projecting outside of upper housing 20 while turning in a bearing 78 in the latter, and on which any type of output drive element can be mounted, for example, pulley 80 for a belt.

OPERATION

The operation of the hydraulic machine according to this invention is described below with reference to FIGS. 1 and 3A to 3D. When a fluid under pressure, such as conventional hydraulic oil, is delivered by a pipe to intake passage 68, this intake passage, by its pressure, fills intake chamber 40 and central bore 38, which communicates with it, via shaft 32. The pressure of the fluid further directs the latter through each radial passage 58, and individual plates **60*a* of each distribution and separation element 60 are thus pushed back toward the inner wall of bore 12 delimiting working chamber 28, for each one to assure a solid fluid tightness with this working chamber and to separate the working chamber into two spaces isolated from one another. The fluid under pressure is then directed through hollow distribution passage 62 to enter into space 82 of working chamber 28 located on the side of drive face 64 or element 60, to the right of the latter in FIG. 3A. In this connection it must be noted that, element 60 being pushed outward by the fluid pressure prevailing at the bottom of recess 56, an output hole of distribution passage 62 is thus uncovered by the adjacent lateral edge of recess 56 of the rotor, and this makes it possible, to the extent the angular position of the rotor is such that the radial distance between the outer face of the rotor and the inside wall of chamber 28 is sufficient, for the fluid under pressure to penetrate into space 82** of the chamber, called the active space.

Figure 3A:
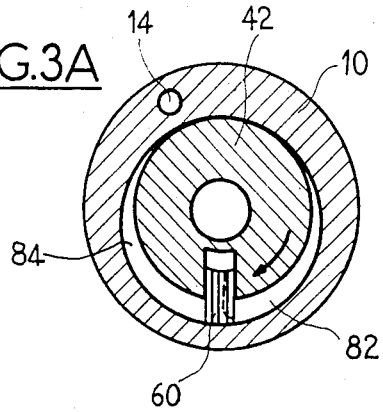
Figure 3B:
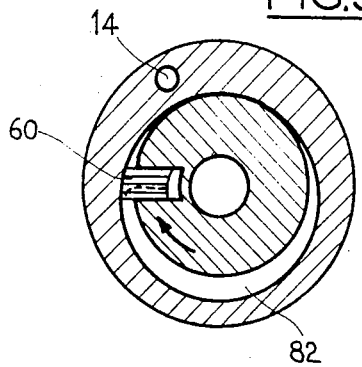
Figure 3C:
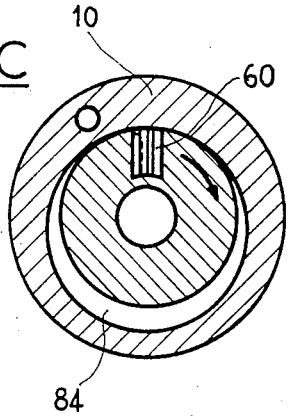
Figure 3D:
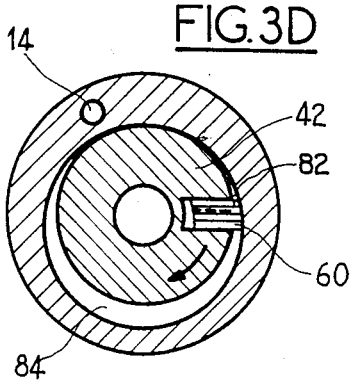

The fluid being accumulated in said space, its pressure will push back element 60 to the left in FIG. 3A, thus to drive rotor 42, and therefore shaft 32, in a clockwise direction in this Figure, this rotation leading to the configuration shown in FIG. 3B.

The pressure continuing to be exerted and the rotor continuing thus to turn, plates **60*a* constituting element 60 gradually retract into recess 56, because the distance between the outside face of the rotor and the inside wall of chamber 28, or chamber width, diminishes. In this connection, in the position shown in FIG. 3C, distribution and separation element 60 is completely retracted into recess 56, and output hole of distribution passage 62 is just blocked by the adjacent edge of the rotor, space 82 then becoming isolated from the intake of fluid under pressure and a period of inactive operation thus appearing in the contact region of rotor 42 and of the wall of working chamber 28. It can be noted that angular distance corresponding to this period of inactive operation is a function, as is understandable, of the radial distance which separates the radially outside end of element 60** from the outside end of the hollow distribution passage 62, a distance indicated by "d" in FIG. 2. There will be selected for the value of this distance "d" a compromise a function, on the one hand, of the requirements for sturdiness and fluid tightness of element 60, and on the other hand, of the requirement for a minimal duration of the inactive period.

Again with reference to FIGS. 3A to 3D, rotor 42 continuing to turn from the position shown in FIG. 3C to the position shown in FIG. 3D (this rotation of inactive period taking place in view of the fact that the three other rotors, out of phase, are in an active period and continue to drive shaft 32), the output hole of distribution passage 62 is again uncovered (FIG. 3D) and the fluid under pressure directed as above again fills active space 82 of working chamber 28, on the side of drive face 64 of element 60, while escape face 66 of said element 60 drives the fluid located in the space 84, which becomes inactive or inert, of the working chamber, this fluid no longer being under pressure, as indicated above, and being driven through radial passage 16 of outside housing 10 to output bore 14 placed in a suitable angular position, in the region corresponding to the inactive period so as to be always in communication with inactive space 84, but never in connection with active space 82. The output fluid is then directed through output passage 72 of housing 30 to the fluid recovery pipe (not shown).

The cycle illustrated by FIGS. 3A to 3D is thus carried out, with the phase shifts mentioned, by the four rotors 42 which drive shaft 32 and, by its extension 76, pulley 80, or any other drive element, continuously, with, as advantageous characteristics, a very nearly 100% efficiency, if the various fluid tightnesses and bearings are correctly designed, a practically instantaneous start and stop, negligible heating, with possibilities for operating for considerable periods of time without breakdown.

Further, a high output power and a high rotation speed can be obtained with a hydraulic machine as described while keeping small dimensions. For example, tests of prototypes have shown that a machine with a diameter of 22 cm and a length of 50 cm transmit 600 horsepower at speeds exceeding 3000 rpm.

Moreover, it is particularly easy to reverse the direction rotation of such a machine, either by returning the distribution and separation elements 60 into their recesses 56, or again by reversing the fluid input and output of the machine.

Finally, by suitably controlling the pressure and flow of the intake fluid, the rotation speed can be easily made to vary continously between zero speed and the nominal speed, with great precision, and the torque and the output power can be made to vary correspondingly.

A possible application of the hydraulic machine according to the present invention is diagrammatically illustrated in FIG. 6. In this Figure, a diesel engine 100 of suitable power drives a centrifugal pump 102 whose output of hydraulic fluid under pressure is connected, by a valve or solenoid valve 104, on the intake side of hydraulic machine 106 of the invention, whose fluid output is connected to the input of said pump 102. Turbine 106 drives, by a system with suitable pulleys and belts, indicated overall by 108, a pump 110 intended, for example, for pumping at the bottom of an artesian well. In this case, the lines between pump 102 and turbine 106 extend from the surface down to the bottom of the well.

An essential advantage of this invention appears clearly here, according to which it is possible to transfer energy, in hydraulic form, between centrifugal pump 102 and hydraulic machine 106 over great distances and without any loss of energy, as opposed to various losses inherent in the transfers of conventional electrical and mechanical energy.

It can further be noted that the same machine, of inexpensive and simple design, no metal or alloy with particular characteristics being necessary, can be used advantageously for numerous rotation speed and power configurations, with no internal modification.

Of course, this invention is not limited to the described embodiment, and includes within its scope all variants and modifications made by those skilled in these arts. In particular, the number of working chambers in superposition and the number of distribution elements, could be modified without going outside the scope of the invention. It is possible to make use of a housing bore exhibiting a bi-eccentricity, see FIG. 7, two cresent-shaped working chambers 128 being thus exhibited at each stage and the associated rotor 142 comprising two diametrically opposed distribution and separation elements 160.

In addition, the angular offset between rotors 42 is, of course, a function of the number of these rotors; for example, it is about 120° for 3 rotors, 90° for 4 rotors, 60° for 6 rotors, etc. Moreover, distribution elements 60 will each be able to be made by suitable machining of a unit block, instead of consisting, as illustrated above, of a laminated structure. Finally, each distribution element can comprise, instead of the single groove 62 as shown in FIG. 5, a multiplicity of parallel, axially spaced grooves; in this case, the fluid tightness and the mechanical resistance can be improved.

It will be noted that the structure of the above-described machine advantageously makes possible the use of any type of working fluid (pressurized oil, water or air . . . ). Finally, in addition to the pumping application described above, the machine is suited to numerous other uses such as: oil drilling and extraction, circulation of fluid in pipes, etc.

What is claimed is:

1. In a hydraulic machine of the type comprising a multiplicity of aligned chambers, each housing a cylindrical rotor in eccentric relation to the chamber and each being provided with a radially extensive cavity receiving radially movable distribution and separation elements, the chambers including walls having openings for the discharge of hydraulic fluid, the improvement in which;

said rotors each comprise a grooves axial bore, and a radial passage between said bore and each radial cavity; and a grooved and hollow central shaft having a multiplicity of passages in alignment with the passages respectively associated with each cavity, said shaft constituting valveless means for simultaneously introducing fluid into chambers and angularly fixing the various rotors relative to one another.

2. A machine for converting a pressurized fluid flow into a mechanical output, said machine comprising:

a housing including a first opening adapted for connection to a source of said pressurized fluid, a second opening, and a plurality of working chambers, said housing rotatably supporting a hollow, grooved output shaft including an aperture along the shaft length for each chamber, one end of said shaft communicating with said first opening to introduce said pressurized fluid into said hollow shaft, each said chamber including a cylindrical rotor having a central opening corresponding grooved configured for mating engagement with, and coaxially about, said grooved shaft whereby rotation of said grooved shaft drives each said rotor in the same direction of rotation as said shaft, each chamber and its respective rotor defining an annular work space of variable width, said width being substantially zero at at least a line of contact between the rotor and a wall of said chamber, each said rotor including radial passage means, aligned with a respective one of said shaft apertures, for selectively directing said pressurized fluid introduced into said hollow shaft to the work space associated with said rotor, said radial passage means housing a distribution and separation element, the latter including a laterally disposed distribution passage and being supported for radial sliding to a radially extended position occuring when said pressurized fluid is capable of being directed to the work space, in which said work space is separated into a first space communicating via said distribution passage with said respective shaft aperture, and a second space isolated from said respective shaft aperture, said second space being in communication with said housing second opening, whereby in each chamber the accumulation of said pressurized fluid in said first space bears against said distribution and separation element and causes said rotor to rotate in the direction of said second space while the fluid in said second space is simultaneously driven therefrom through said housing second opening, whereupon rotative movement is imparted to said output shaft.

3. Machine according to claim 2, wherein said working chamber comprises a bore eccentric in relation to the axis of the rotor.

4. Machine according to claim 2, wherein each distribution and separation element consists of a multiplicity of superposed plates.

5. Machine according to claim 2, wherein the distribution passage comprises a hollow made in the distribution and separation element and that extends between the bottom of said element and the radially outside part of one of the lateral faces of said element.

6. Machine according to claim 2, wherein housing the respective angular positions of the distribution and separation elements of each rotor being offset in relation to one another.

7. Machine according to claim 2, wherein each said working chamber comprises the joining of two bores eccentric in relation to the axis of the rotor, each rotor comprising two diametrically opposed distribution and separation elements.

8. Machine according to claim 2, wherein the housing second opening comprises at least a radial passage made in the wall of each said chamber in the region of the line of contact between the rotor and said wall.

* * * * *